US007408844B2

(12) United States Patent
Zaugg et al.

(10) Patent No.: US 7,408,844 B2
(45) Date of Patent: Aug. 5, 2008

(54) CALENDAR WATCH PROVIDED WITH LOCKING MEANS

(75) Inventors: Alain Zaugg, Le Brassus (CH); Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 11/615,147

(22) Filed: Dec. 22, 2006

(65) Prior Publication Data

US 2007/0147177 A1 Jun. 28, 2007

(30) Foreign Application Priority Data

Dec. 22, 2005 (EP) ..... 05112793

(51) Int. Cl.
*G04B 27/06* (2006.01)

(52) U.S. Cl. ..... 368/31; 368/35

(58) Field of Classification Search ..... 368/35, 368/31

See application file for complete search history.

(56) References Cited

U.S. PATENT DOCUMENTS 3,748,848 A * 7/1973 Laesser et al. ..... 368/31
3,866,407 A * 2/1975 Wuthrich ..... 368/35
7,218,576 B1 * 5/2007 Bron ..... 368/35
2003/0189875 A1 * 10/2003 Wilmouth ..... 368/35

FOREIGN PATENT DOCUMENTS

| | | |
|---|---|---|
| CH | 1018 | 5/1889 |
| CH | 5900 | 12/1892 |
| DE | 2 060 056 | 6/1972 |
| GB | 2 369 897 A | 6/2002 |

OTHER PUBLICATIONS

European Search Report issued in corresponding application No. EP 05 11 2793 completed Nov. 13, 2006.

* cited by examiner

*Primary Examiner*—Renee S. Luebke
(74) *Attorney, Agent, or Firm*—Griffin & Szipl, P.C.

(57) ABSTRACT

A calendar watch is arranged to allow time-setting to be carried out without this operation altering the state of the calendar mechanism at the passage to midnight. This mechanism, which is of the instantaneous date type, includes a large lever (2) loaded by a spring and wound by a spiral shaped cam (11) and a click (20) released at midnight by a flexible finger (12) of a 24-hour wheel (10). The mechanism prevents any transmission of movement from the 24 hour wheel to the date wheel set, when they are set in the active position by the winding stem (33) pulled out into the time-setting position of the watch. A pivoting isolator (30), which, in its active position, abuts against the click (20) prevents the click from releasing the lever (2).

5 Claims, 5 Drawing Sheets

CALENDAR WATCH PROVIDED WITH LOCKING MEANS

This application claims priority from European Patent Application No. 05112793.4, filed Dec. 22, 2005, the entire disclosure of which is incorporated herein by reference.

BACKGROUND OF THE INVENTION

The present invention concerns a watch having time-setting means and a calendar mechanism comprising a lever loaded by a spring and released once a day from a 24 hour wheel, which is driven by the watch movement to complete one revolution per day, the effect of the release of the lever being to move a date wheel set, for example including a star wheel, forward one step in the calendar mechanism.

The invention applies in particular, but not exclusively, to a so-called instantaneous date watch, wherein the calendar mechanism comprises a spiral shaped cam, secured to the 24 hour wheel and acting on the lever to wind it progressively during one day against the lever spring, a click provided with a return spring tending to set it in a stop position in which the click restrains the lever in the wound position against the lever spring, and a release finger arranged on the 24 hour wheel to act at a determined time on the click such that the latter releases the lever. This type of calendar mechanism arrangement has the advantage of moving the date wheel set forward instantaneously, for example each day around midnight owing to the action of the 24 hour wheel, so that the date and day indicators give correct indications before and after midnight. Such mechanisms are well known and the reader can find a description thereof in Swiss Patent No. 1018 for example.

In conventional calendar watches, when one moves the hands manually in order to set the time of the watch, for example because it has stopped, the 24 hour wheel can pass through its midnight position and activate the calendar mechanism by incrementing the date and the day of the week, and where necessary the moon phase indicator. The user does not always wish to perform this action, which can be inconvenient, in particular because of its cascade effect in a perpetual calendar mechanism, and in certain cases, he would prefer to adjust the date separately by means of the usual manual correctors, each acting on one of the calendar indicators.

SUMMARY OF THE INVENTION

The present invention concerns a calendar watch of the type indicated in the above preamble, arranged to allow the time to be set without this operation altering the state of the calendar mechanism.

More specifically, a watch according to the invention is characterized in that the calendar mechanism comprises locking means, having an active position in which they prevent any transmission of movement from the 24 hour wheel to the date wheel set, and in that the locking means are set in the active position by the time-setting means when the latter are set in the time-setting position of the watch. As a result, at the passage to midnight while the time is being set, not only does the date wheel set remain motionless, but so do other elements of the mechanism able to be driven by this wheel set, particularly a month counter and a year counter.

According to a preferred embodiment, the locking means are arranged to prevent the lever moving under the effect of the lever spring. Thus, all the calendar elements whose movement flows from the action of this lever, even if they are not driven by the date wheel set, necessarily remain motionless while the user sets the time of his watch, even when the 24 hour wheel passes through its midnight position.

In the case of a calendar mechanism with instantaneous date display as defined hereinbefore, the locking means can advantageously include an isolator wheel set, which, in its active position, abuts against the click so as to prevent it from releasing the lever. According to an advantageous embodiment, the release finger installed on the 24 hour wheel is resilient, which enables it to yield when it abuts against the click locked by the isolator in the midnight position. Time-setting is thus carried out without any difficulty.

BRIEF DESCRIPTION OF THE DRAWINGS

Other features and advantages of the present invention will appear from the following description, which presents by way of non-limiting example a preferred embodiment of the invention, with reference to the annexed drawings, in which.

DETAILED DESCRIPTION OF ONE EMBODIMENT

Figure 1:
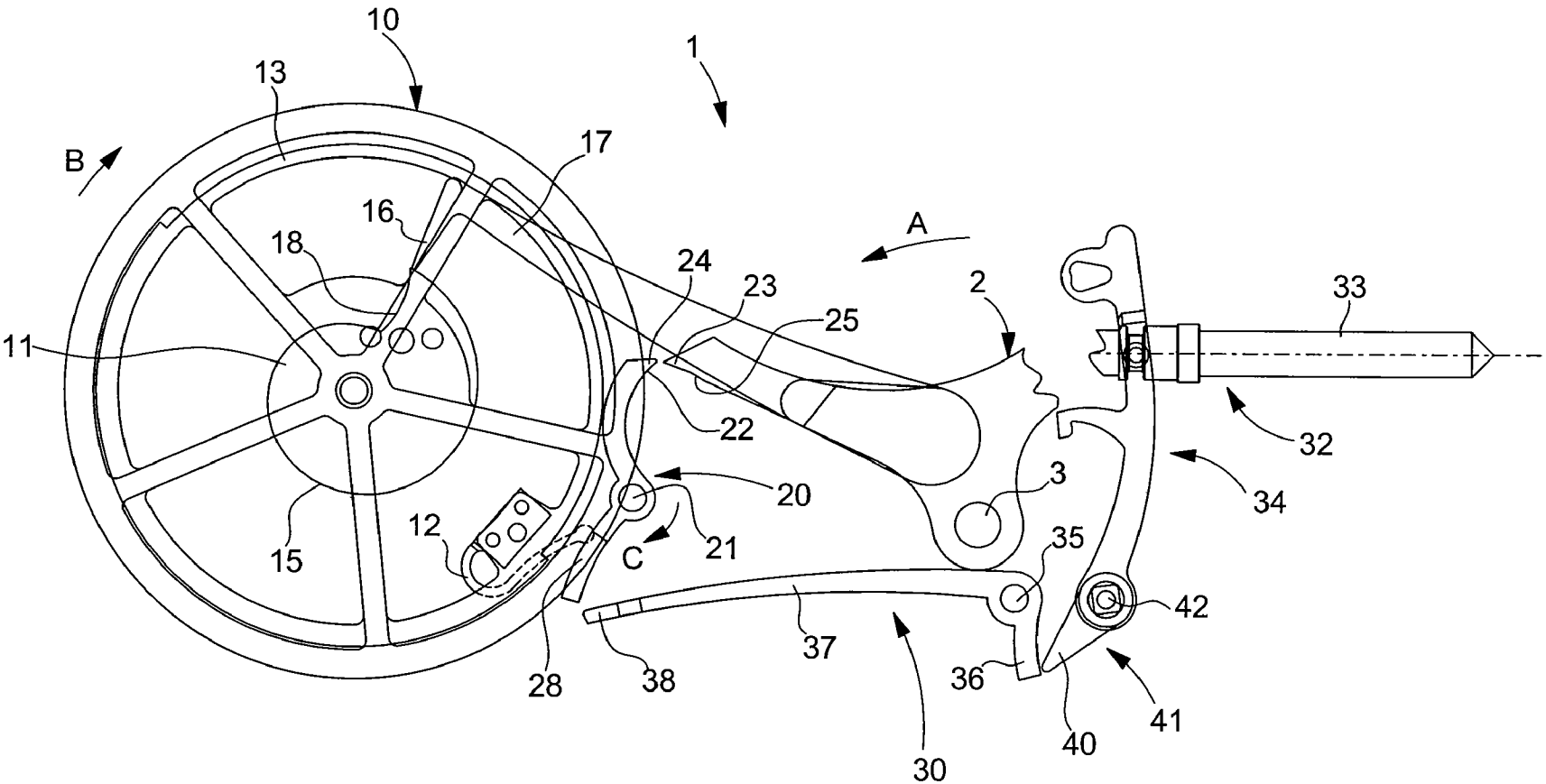
FIG. 1 is a schematic plan view showing the elements that control the daily movement of a large lever of an instantaneous perpetual calendar mechanism in a watch, and an isolator able to inhibit the release of the large lever.
Figure 2A:
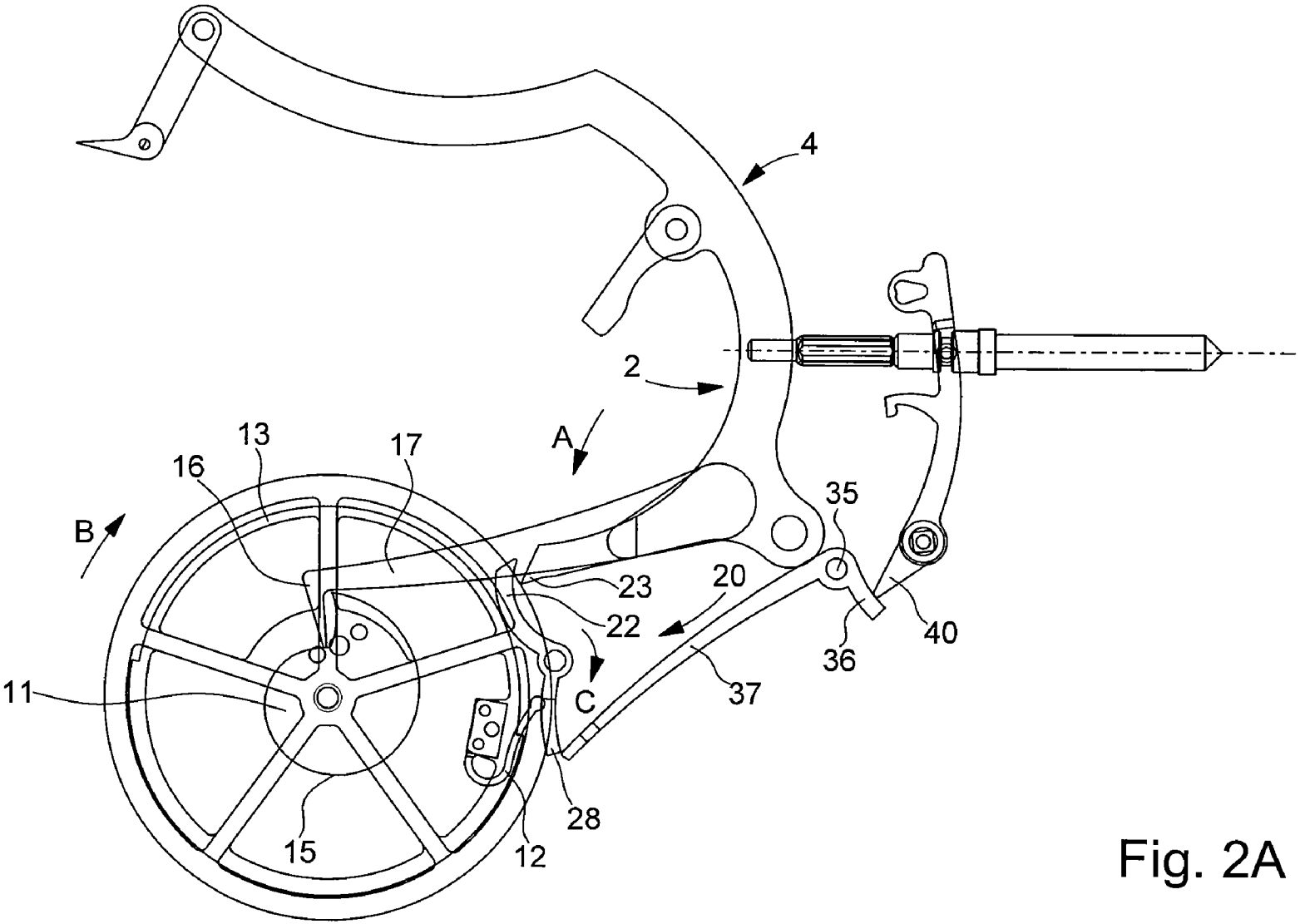
FIGS. 2 to 4 show in perspective different positions of the elements of FIG. 1 at around midnight.
Figure 2B:
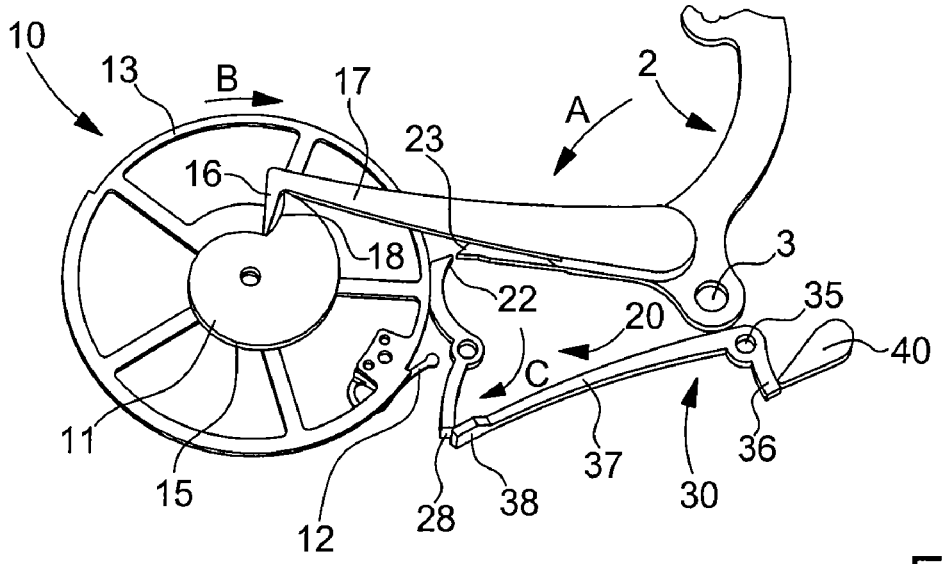

Watches having a calendar mechanism activated by a daily movement of a large lever, whether this mechanism is simple, annual or perpetual and activated with drag or instantaneously, are well known and this type of mechanism does not therefore need to be described here. It can simply be seen in the drawings that the calendar mechanism 1, which is activated instantaneously here, comprises a large lever 2 pivoting at 3 and permanently biased by a spring 4 represented schematically here by an arrow, tending to pivot lever 2 about its pivot 3 in the direction indicated by arrow A. In a known manner, the movement of the large lever in the direction of A moves a date star-wheel and a day star-wheel forward one step.

The daily alternating movement of large lever 2 is controlled by a toothed wheel 10 called the 24-hour wheel, which is meshed with the hour wheel of the watch movement, possibly via an intermediate wheel, to complete one revolution per day in the direction indicated by arrow B. In order to act on the lever, wheel 10 is fitted with a spiral shaped cam 11 and a release finger 12, which, in this example, is secured to wheel 10 via a second cam 13 for controlling a day/night indicator. The level of finger 12 is different from that of cam 11. In FIGS. 2 to 6, the toothing of wheel 10 has been removed in order to clarify the drawing.

Cam 11 has a spiral shaped peripheral surface 15, against which the bent end 16 of a feeler 17 forming part of lever 2 abuts by sliding via the effect of spring 4, so that the rotation of cam 11 slowly pivots lever 2 in the opposite direction to A. This pivoting of the lever has the effect of winding spring 4 to the position shown in FIGS. 1 and 3. The surface 15 ends in an abrupt radial recess 18, whose passage under point 16 releases feeler 17 at a moment predetermined by the angular mounting position of cam 11 and wheel 10 in relation to the hour wheel. This moment is preferably several minutes before midnight.

Figure 3:
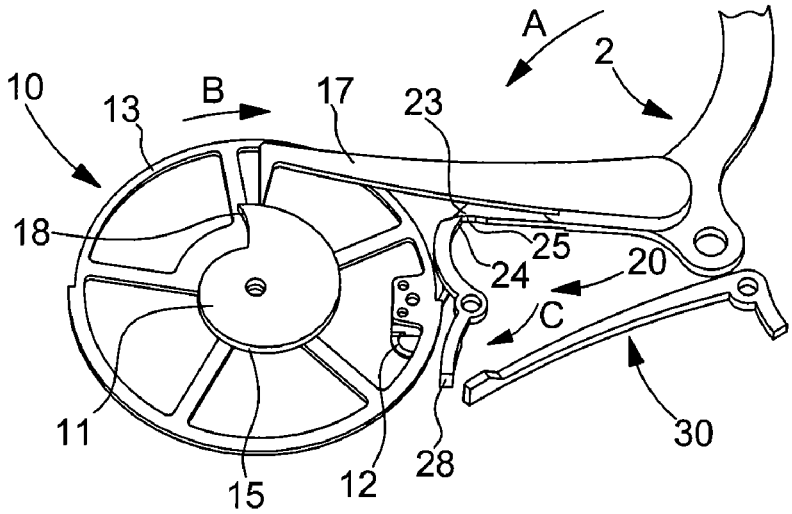
Figure 4:
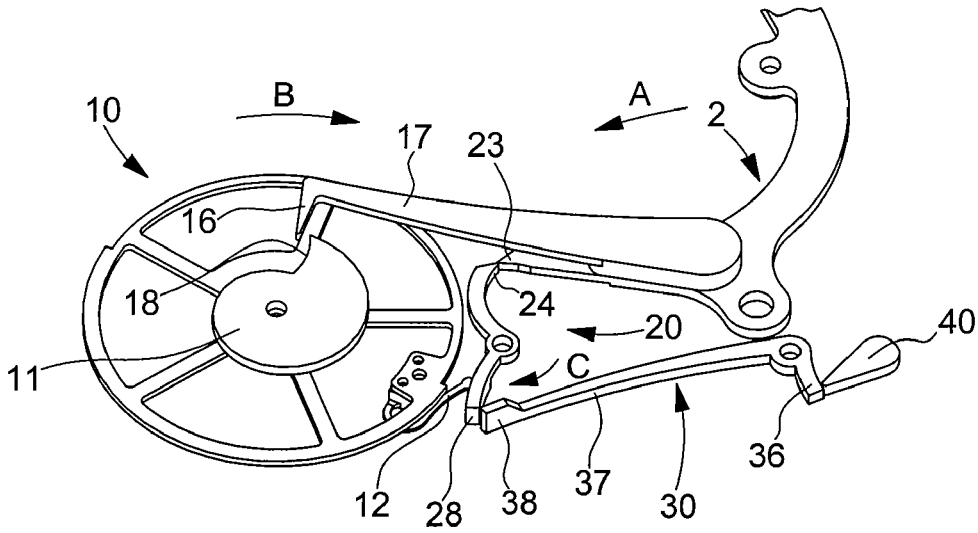

Release finger 12 is for releasing the instantaneous return of lever 2 at a more precisely defined time than cam 11 can do. For this purpose, a click 20 is provided, pivoting at 21 and biased by a spring in the direction of arrow C so that one flank 22 of the click, in a position like that shown in FIG. 2, abuts against a beak 23 of lever 2 while the latter has not yet reached its wound position. As soon as this position is reached, the effect of the spring moves forward point 24 of click 20 underneath one edge 25 of the lever as shown in FIG. 3. A stop member that is not shown stops the click in this position. Thus, at the aforementioned moment when the point of feeler 17 clears recess 18 of cam 11, click 20 is still holding lever 2 in the wound position, as shown in FIG. 4. It is only a few instants later, preferably just at midnight, that end 27 of release finger 12, abutting by sliding against the back arm 28 of the click, pivots the latter in the opposite direction to C. The point 24 of the click then passes to the left of beak 23 and enables lever 2 to pivot abruptly in the direction of A to the position of FIG. 2*a*, 2*b*, to rotate the date star-wheel through one step, and if necessary, to fulfil any other daily function attributed thereto.

The time-setting operation of the watch rotates the hour wheel with the hour hand and, consequently, also rotates 24-hour wheel 10 and cam 11. When the mechanism passes through the midnight position, if the action of release finger 12 was not inhibited by an isolator 30 that intervenes via the action of time-setting means 32, the aforementioned release of lever 2 would occur. The time-setting means comprise here, in a conventional manner, a winding stem 33 which moves a lever 34 when it is pulled out to a time-setting position.

Figure 5:
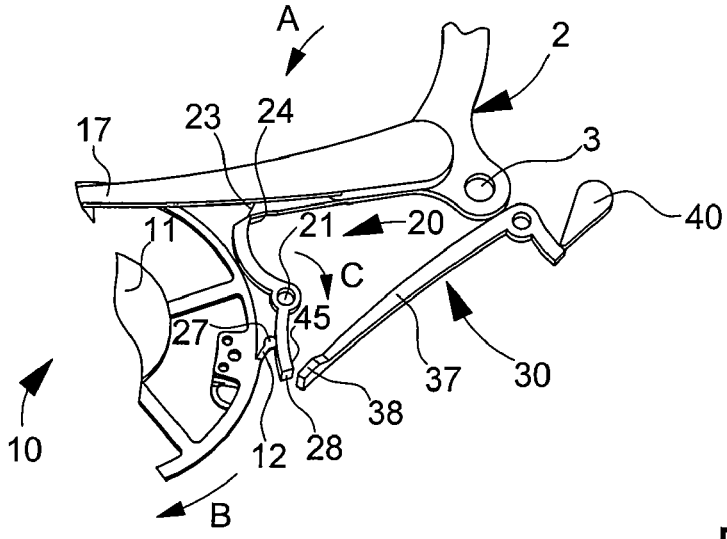
FIG. 5 shows in more detail the position of FIG. 4 in normal conditions.

In the example shown in the drawings, isolator 30 has the shape of a lever mounted on a pivot 35 and having a short back arm 36 and a long, slightly flexible front arm 37, and having a palette-stone 38 at the free end thereof, next to the end of back arm 28 of click 20. One side of back arm 36 abuts against a control finger 40 forming part of a lever 41 pivoting at 42 and connected to lever 34. While winding stem 33 is not in the time-setting position, the control finger 40 is withdrawn into the neutral position shown in FIGS. 2 to 4. Isolator 30 abutting against finger 40 also occupies a neutral position in which palette-stone 38 of its arm 37 is beyond the end of back arm 28 of click 20. At midnight, the release finger 12 pushes this arm 28 back in the direction of a lateral face of palette-stone 38, as shown in FIGS. 4 and 5. The resistance that long arm 37 of the isolator can oppose to click 20 in these conditions is lower than the force of finger 12, so that the isolator can bend to allow the click to pivot and thus allow large lever 2 to operate normally.

Figure 6:
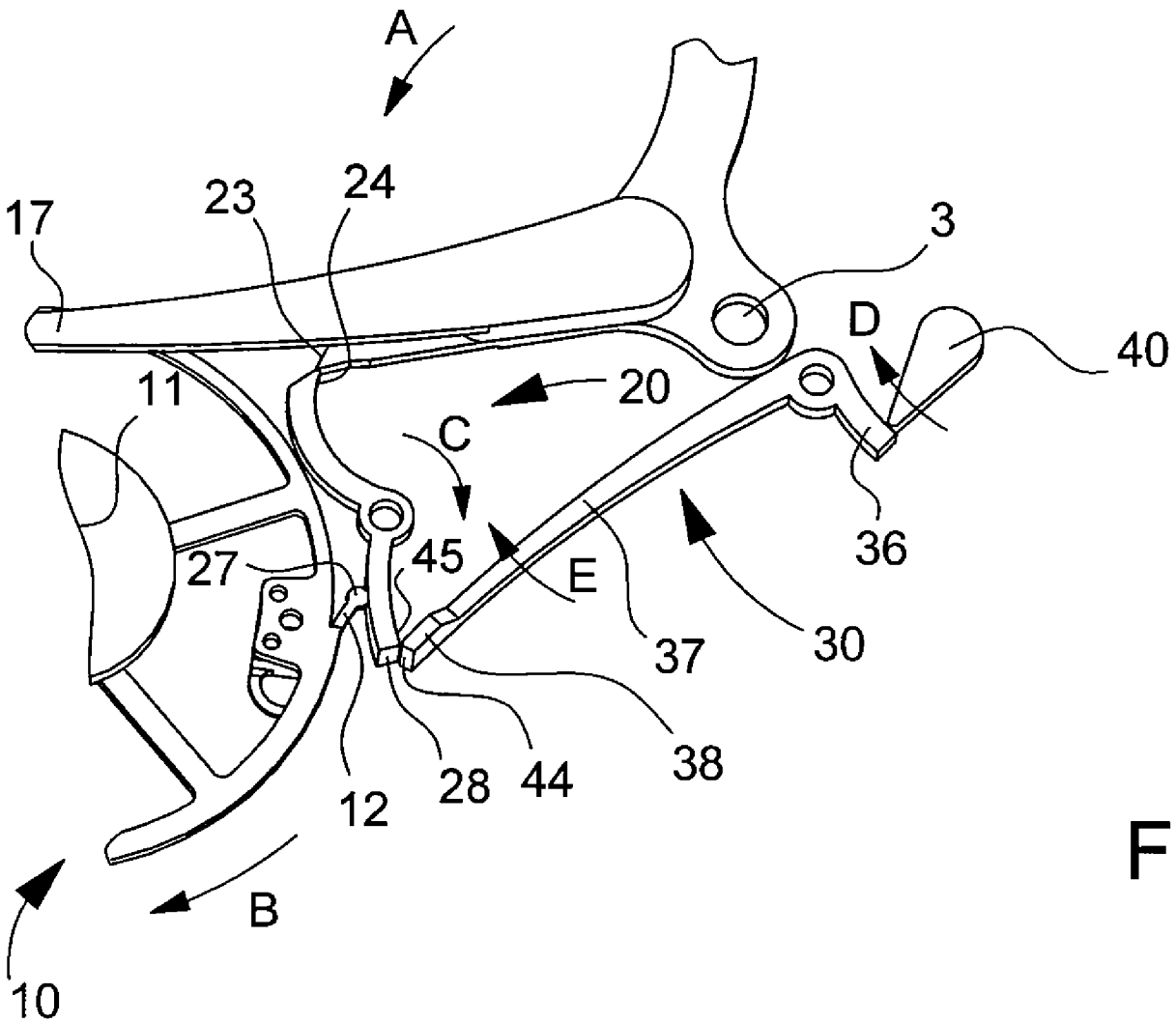
FIG. 6 shows the position of FIG. 4 when the time of the watch is being set.

Conversely, during the time-setting operation, putting stem 33 into the pulled-out position causes control finger 40 and isolator 30 to pivot as indicated by arrows D and E, to set these two elements in their active position shown in FIG. 6. It is then the front edge 44 of palette-stone 38 that abuts against click 20, more precisely against flank 45 of back arm 28 of the click. In these conditions, the resistance that isolator 30 opposes to click 20 is much greater than the thrust of resilient finger 12. The click cannot pivot in the opposite direction to arrow C, thus it restrains lever 2 during the passage to midnight and the rest of the time-setting operation.

The locking means comprising isolator 30 in the form of a pivoting lever in this example has the advantage of being simple, reliable and compact. However, it could be made differently, for example with an isolator formed by a sliding part or a part whose end is raised to create a stop member opposite the click, but solutions of this kind are less appreciated by watchmakers.

It should also be noted that, instead of preventing the movement of the large lever, the locking means according to the invention could be arranged to neutralise the effect of such movement. This is possible for example when the large lever acts on the date counter by means of an arm resiliently hinged on the lever, as can be seen for example in GB Patent Application No. 2369897. The isolator need only be placed on the trajectory of the arm to push it back at a distance from the teeth of the date counter during the time-setting operation.

What is claimed is:

1. A watch having time-setting means and a calendar mechanism including a lever biased by a spring said lever being released once a day from a 24 hour wheel, which is driven by the watch movement to complete one revolution per day, an effect of release of the lever being to move a date wheel set one step forward in the calendar mechanism, wherein the calendar mechanism includes locking means having an active position in which said locking means prevent a transmission of the movement of the 24 hour wheel to the date wheel set, and wherein the locking means are set in active position by the time-setting means when said time setting means are set in the position for setting the time of the watch.

2. The watch according to claim 1, wherein the locking means are arranged to prevent the movement of the lever under the effect of the lever spring.

3. The watch according to claim 2, wherein the calendar mechanism includes a spiral shaped cam, secured to the 24 hour wheel and acting on the lever to wind said spiral shaped cam gradually during one day against the lever spring, a click associated with a return spring tending to set said click in a stop position in which the click restrains the lever in a wound position against the lever spring, and a release finger arranged on the 24 hour wheel to act at a determined time on the click such that said click releases the lever, and wherein the locking means include a mobile isolator, which, in the active position thereof, abuts against the click so as to prevent said click from releasing the lever.

4. The watch according to claim 3, wherein the release finger is resilient.

5. The watch according to claim 4, wherein the isolator is formed by a pivoting lever and includes a long arm one end of which, in said active position, abuts against one side of the click.

* * * * *